US008317273B2

(12) United States Patent
Alexander

(10) Patent No.: US 8,317,273 B2
(45) Date of Patent: Nov. 27, 2012

(54) MODULAR DISPLAY AND DISPENSING SYSTEM AND MODULE DEVICE FOR BUILDING A DISPLAY AND DISPENSING SYSTEM

(75) Inventor: Jeffrey Alexander, Oradell, NJ (US)

(73) Assignee: Applied Merchandising Concepts, LLC, New Rochelle, NY (US)

( * ) Notice: Subject to any disclaimer, the term of this patent is extended or adjusted under 35 U.S.C. 154(b) by 272 days.

(21) Appl. No.: 12/622,288

(22) Filed: Nov. 19, 2009

(65) Prior Publication Data

US 2010/0295424 A1 Nov. 25, 2010

Related U.S. Application Data

(60) Provisional application No. 61/116,131, filed on Nov. 19, 2008.

(51) Int. Cl.
*B65D 83/02* (2006.01)

(52) U.S. Cl. ..... 312/72; 312/35; 211/59.2

(58) Field of Classification Search ..... 312/35, 312/42, 45, 60, 72–73; 211/59.2, 74, 194; 221/68, 92
See application file for complete search history.

(56) References Cited

U.S. PATENT DOCUMENTS

| | | | | |
|---|---|---|---|---|
| 2,888,145 | A * | 5/1959 | Knott et al. | 211/59.2 |
| 2,901,118 | A * | 8/1959 | Beesley | 211/59.2 |
| 3,172,713 | A * | 3/1965 | Rupert | 312/235.7 |
| 4,015,885 | A * | 4/1977 | Baggaley | 312/42 |
| 4,243,145 | A * | 1/1981 | Woodhead | 211/59.2 |
| 4,287,992 | A * | 9/1981 | Takemori | 211/59.2 |
| 4,347,952 | A * | 9/1982 | Bookout | 221/129 |
| 5,462,198 | A * | 10/1995 | Schwimmer | 221/130 |
| 5,806,689 | A | 9/1998 | Mays et al. | |
| 6,581,787 | B2 | 6/2003 | Barrett et al. | |
| 6,786,341 | B2 * | 9/2004 | Stinnett et al. | 211/59.2 |
| 6,991,116 | B2 * | 1/2006 | Johnson et al. | 211/59.2 |
| 7,159,739 | B2 | 1/2007 | Fenton et al. | |
| 7,350,648 | B2 * | 4/2008 | Gerstner et al. | 211/87.01 |
| 7,992,747 | B2 * | 8/2011 | Bauer | 221/197 |
| 8,028,855 | B2 * | 10/2011 | White et al. | 221/191 |
| 2004/0217077 | A1 | 11/2004 | Gerstner et al. | |

* cited by examiner

*Primary Examiner* — Hanh V Tran
(74) *Attorney, Agent, or Firm* — Cozen O'Connor

(57) ABSTRACT

A merchandising display and dispensing system for displaying and dispensing articles, including cylindrical shaped articles or rolls of disk-shaped articles. In particular, the invention relates to a modular display and dispensing system having a plurality of modules fitted with one another. Each module comprises a left side panel and a right side panel which are fitted together and form a serpentine chute which feeds articles by gravity to an access tray where an article can be removed by hand, thus permitting another article to enter the tray. The front of the module receives a front cover for covering the chute and provides a surface for indicia of contents inside the module. The front cover is preferably hinged at the bottom to permit reloading product in the top of the chute. Various connecting structures can be formed on the side panels and adapted to join the module to a front cover, to another adjacent module, to a module base, and/or to a module header to form a modular display and dispensing system.

19 Claims, 14 Drawing Sheets

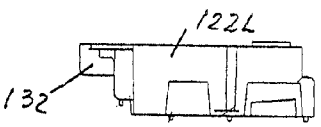
Fig. 8A
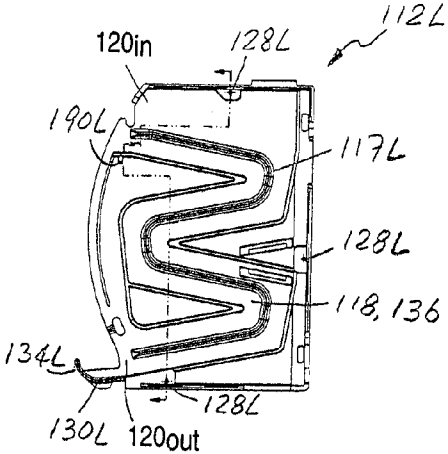
Fig. 8C
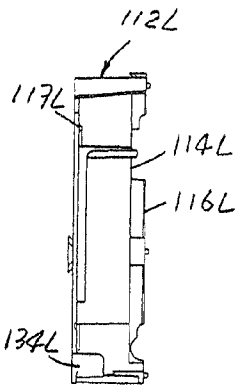
Fig. 8B
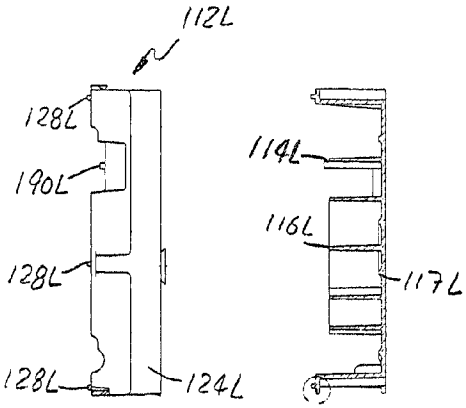
Fig. 8E
Fig. 8D
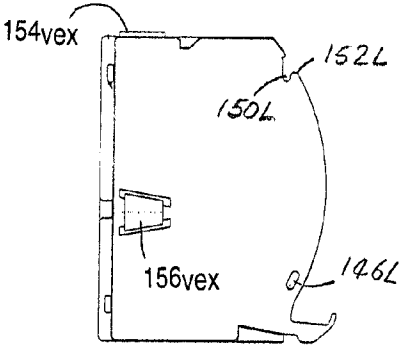
Fig. 8F
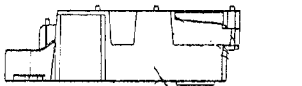
Fig. 8G

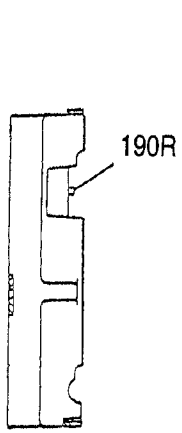
Fig. 9F
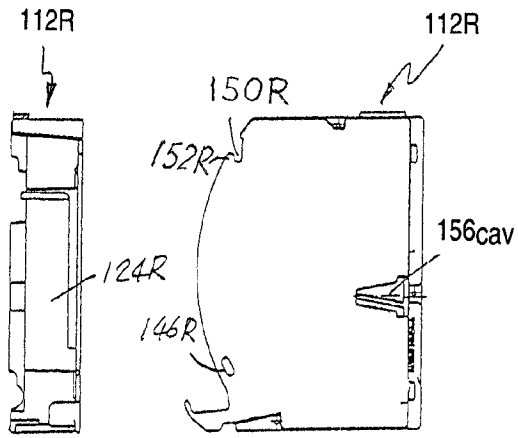
Fig. 9E
Fig. 9D
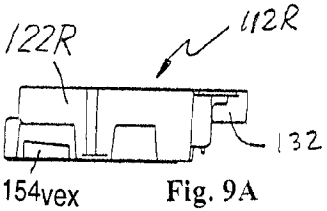
Fig. 9A
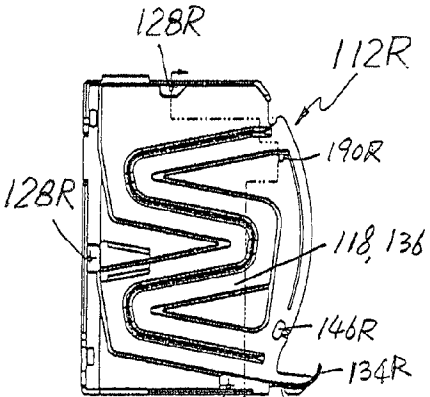
Fig. 9C
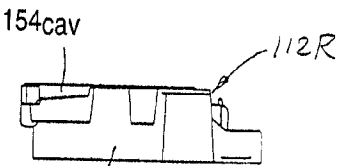
Fig. 9G
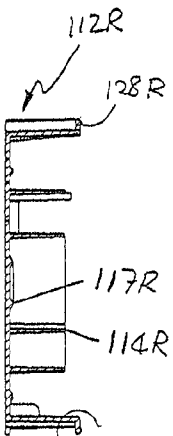
Fig. 9B 180
182

180

182
186
180

180
186

186
182
180

182
186
180

186

180
186

186
182
180
184
184
184

186
180

MODULAR DISPLAY AND DISPENSING SYSTEM AND MODULE DEVICE FOR BUILDING A DISPLAY AND DISPENSING SYSTEM

RELATED APPLICATIONS

The present application claims the benefit of U.S. Provisional Patent Application No. 61/116,131, filed Nov. 19, 2008, which is incorporated herein by reference in its entirety.

FIELD OF THE INVENTION

The invention relates generally to a merchandising display and dispensing system for display and dispensing articles. In particular, the invention relates to a modular display and dispensing system having a plurality of modules fitted with one another. The invention also relates to a module device for constructing a merchandising display and dispensing system.

BACKGROUND OF THE INVENTION

Products in relatively small individual packages are often displayed in and sold from merchandise dispensers that dispense the packages to customers one at a time. Such dispensers are especially useful for small cylindrical product packages that would otherwise be difficult to display on a typical store shelf. The manner in which a product is displayed and dispensed can have a significant impact on sales. This is particularly true in "product-rich" environments, such as grocery and drug stores.

Conventional merchandise dispensers may suffer from certain shortcomings. For example, such dispensers may not display the product in a visually-appealing manner that promotes sales. Conventional dispensers may be difficult and/or inconvenient to reload. Such dispensers may not be amenable to the creation of larger displays by combining a number of separate dispensers.

SUMMARY OF THE INVENTION

The invention relates to a merchandising display and dispensing system for displaying and dispensing articles, including cylindrical shaped products, such as rolls of tablets, or disk-like confections. The display and dispensing system can be formed with a plurality of modules, which can be fitted together to construct a modular display and dispensing system.

Each module comprises a left side panel and a right side panel which are fitted together and form a serpentine chute which feeds rolls by gravity to an access tray where a roll can be removed by hand, thus permitting another roll to enter the tray. The front of the module receives a front cover which covers the chute and provides a surface for indicia of contents inside the module. The front cover is preferably hinged at either its bottom or top to permit reloading product in the chute.

Each module has a rear surface provided with openings for receiving suction cups or hanging on a nail, hook or other mounting device. However it is preferred to mount the modules side-by-side on a base plate by dovetail connections provided on the base plate and the bottoms of the modules. The modules can also be connected to one another vertically by dovetail connections on top of each module, and/or laterally by dovetail connections on the lateral walls of the adjacent modules. Additionally or alternatively, a header can be fitted by dovetail connection across the top row of modules to provide additional retention of the array or rows and columns, as well as additional space for identifying information.

Each module is fitted together by pins and sockets in a press fit, and may also be glued. However, positive mechanical retention is preferably provided by the various dovetail connections when the modules are assembled in an array of rows and columns on the base plate.

BRIEF DESCRIPTION OF THE DRAWINGS

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein. In the drawings:

FIGS. 8A-8G show various views of a left side panel of the module shown in FIG. 7;

FIGS. 9A-9G show various views of a right side panel of the module shown in FIG. 7;

DETAILED DESCRIPTION OF THE EMBODIMENTS

Figure 1:
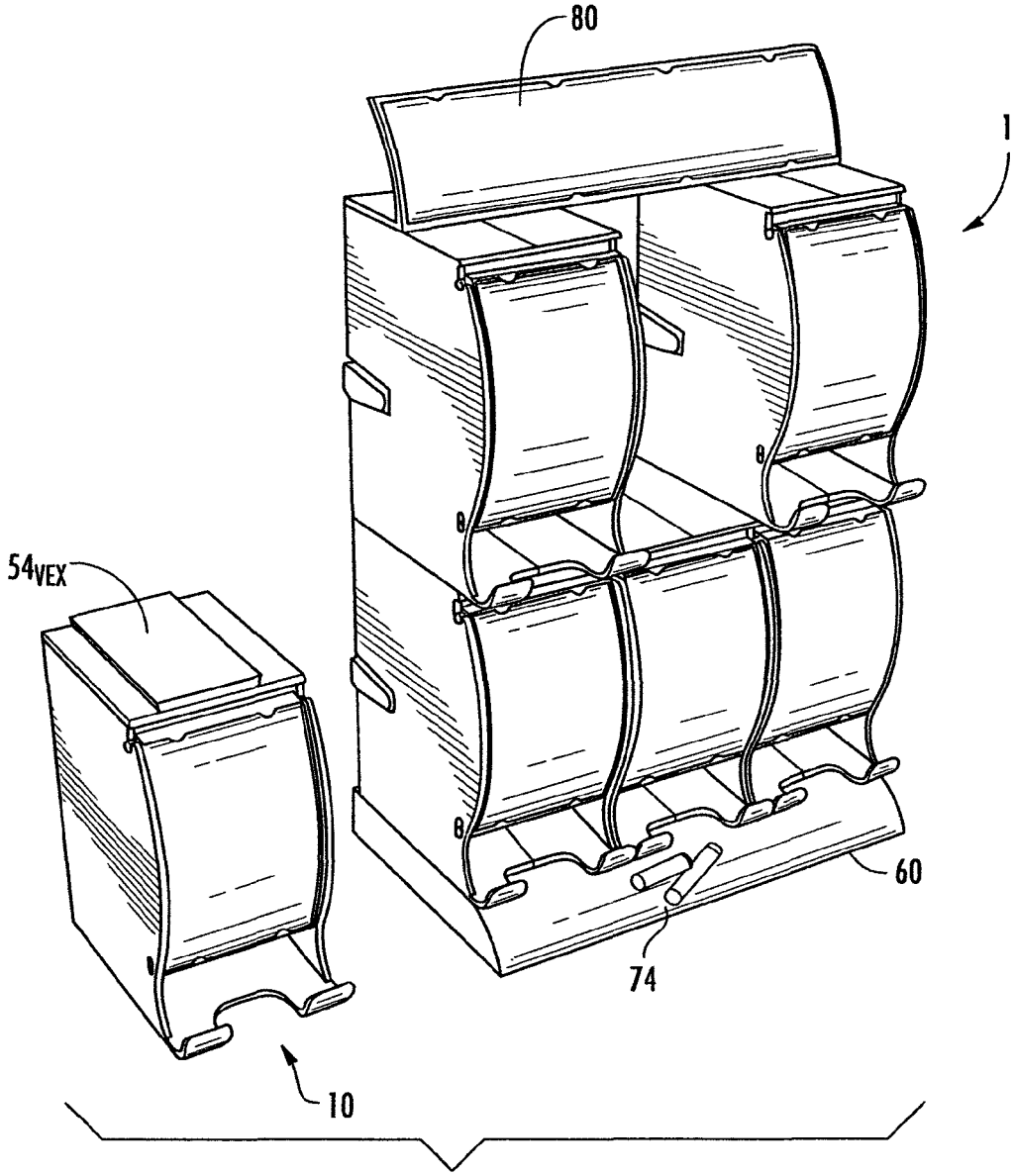
FIG. 1 shows perspective views of a single module and a group of modules assembled in a 2×3 array of rows and columns formed according to a first embodiment.
Figure 2F:
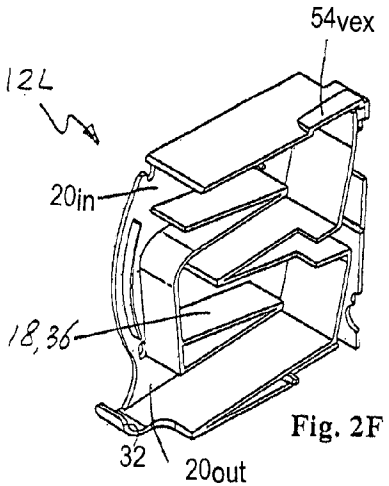
FIGS. 2A-2H show various views of a left side panel of the module shown in FIG. 1.
Figure 2G:
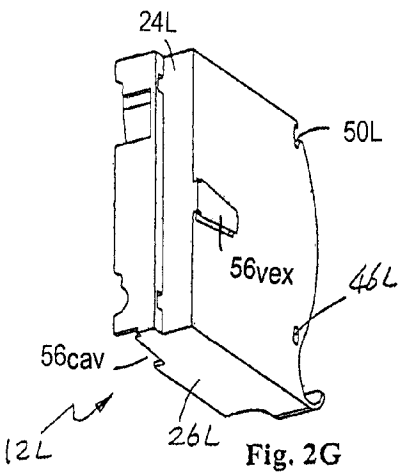
Figure 2E:
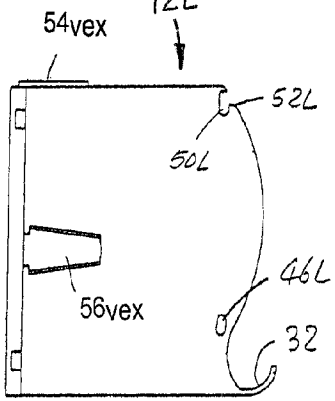
Figure 2D:
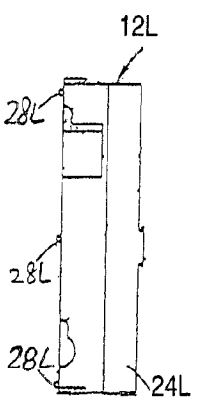
Figure 2A:
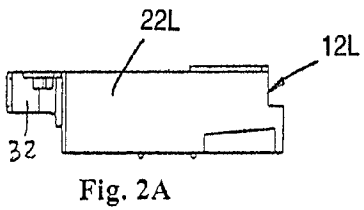
Figure 2C:
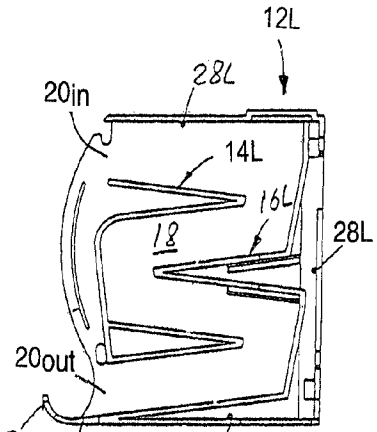
Figure 2H:
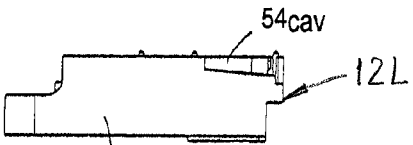
Figure 2B:
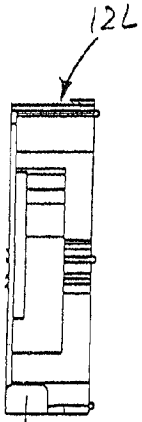

FIG. 1 shows a merchandising display and dispensing system 1 for display and dispensing articles. The display and dispensing system 1 can be formed with a plurality of modules 10, which are interconnected with one another to form a modular system 1. In one embodiment, the multiple modules 10 can be formed to be identical so as to provide interchangeability for the modular system 1. In the example shown in FIG. 1, the display and dispensing system 1 is shown to have a 2×3 array (two rows and three columns) of modules 10. One of such modules 10 is separated from the display and dispensing system 1 and shown side-by-side with the same. Detailed description of such modules 10 will be provided below.

Figures 3A, 3B, 3C, 3D, 3E, 3F, 3G, 3H:
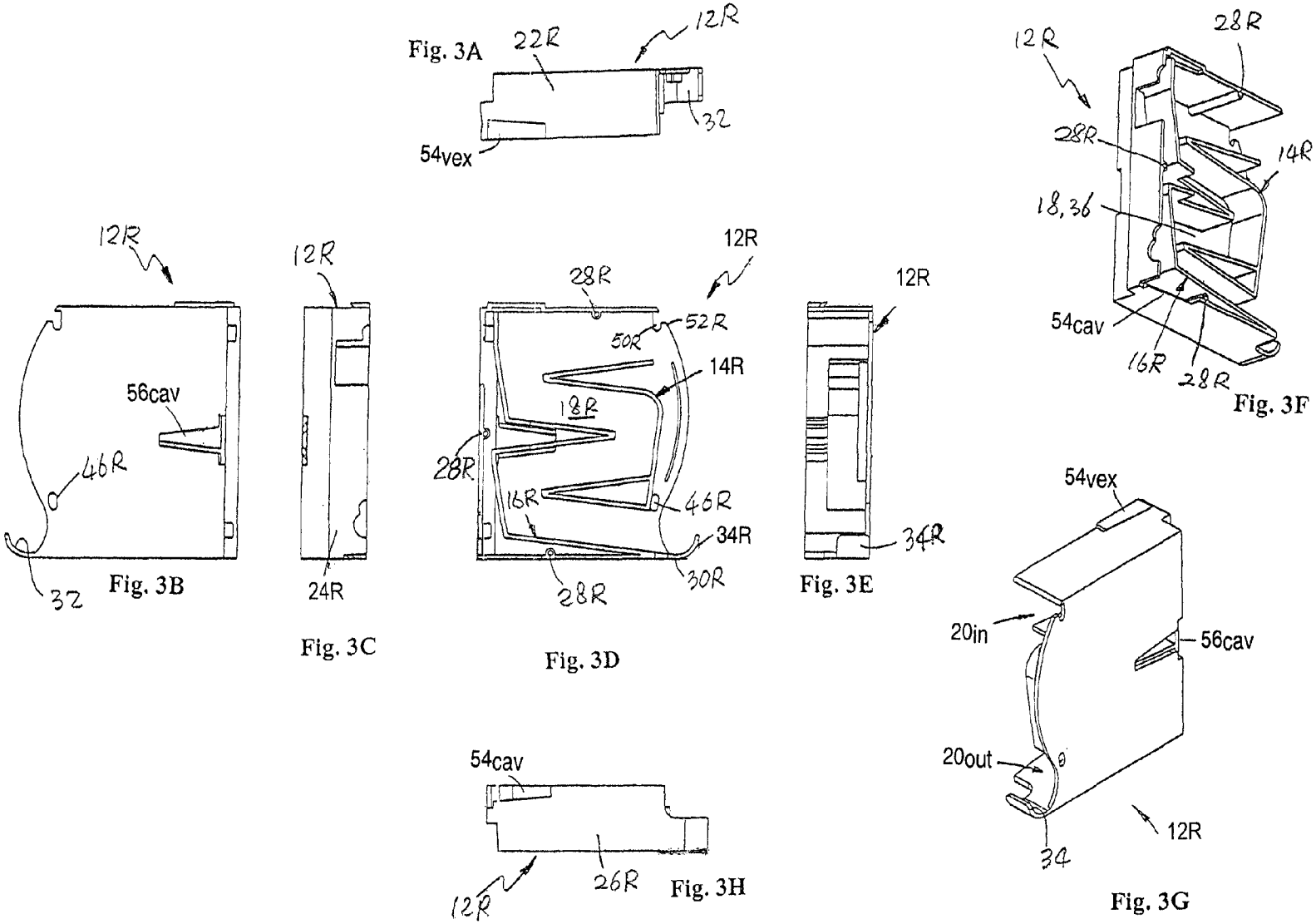
FIGS. 3A-3H show various views of a right side panel of the module shown in FIG. 1.
Figure 4F:
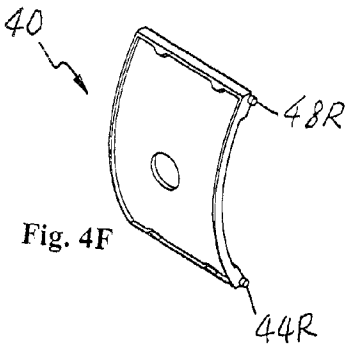
FIGS. 4A-4H show various views of the base of the module shown in FIG. 1.
Figure 4G:
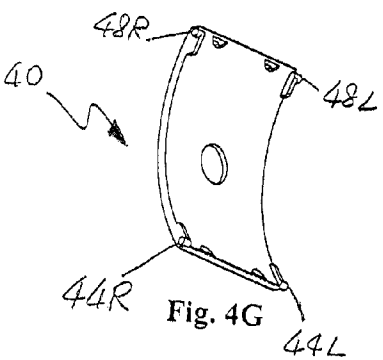
Figure 4E:
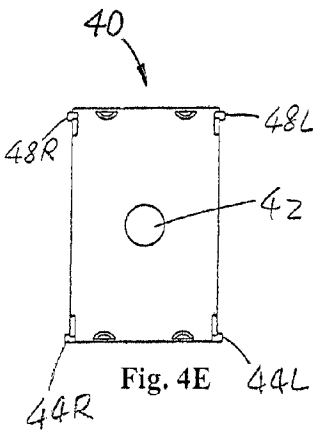
Figure 4D:
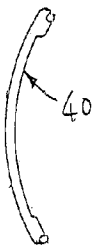
Figure 4A:
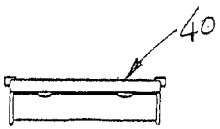
Figure 4C:
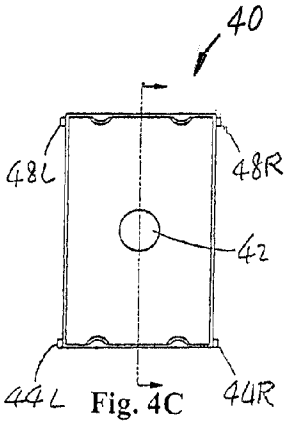
Figure 4H:
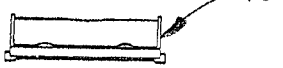
Figure 4B:
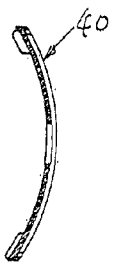
Figure 5E:
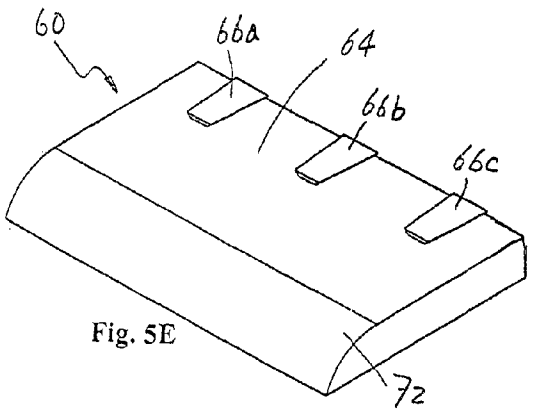
FIGS. 5A-5H show various views of the cover of the module shown in FIG. 1.
Figure 5F:
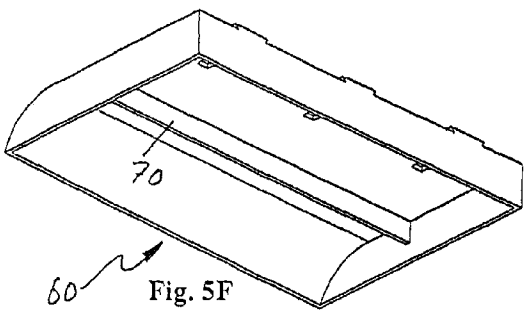
Figure 5D:
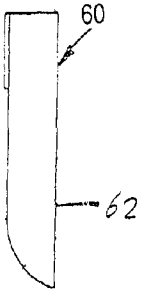
Figure 5A:
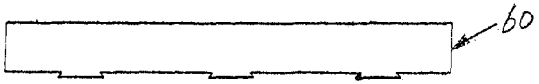
Figure 5C:
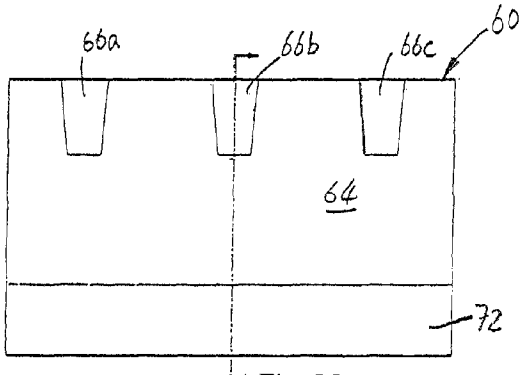
Figure 5G:
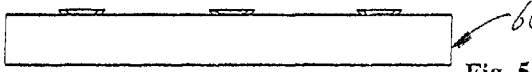
Figure 5H:
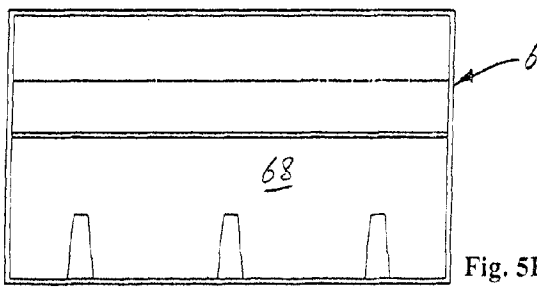
Figure 5B:
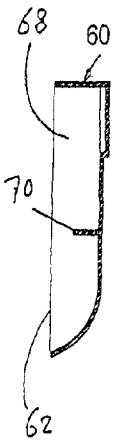
Figure 6E:
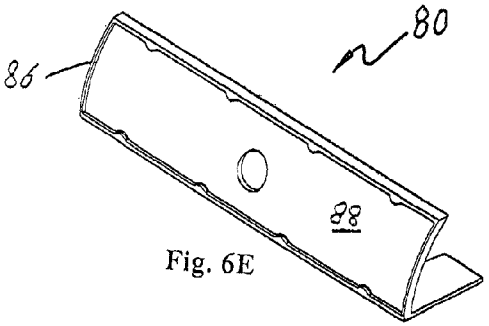
FIGS. 6A-6H show various views of the header of the module shown in FIG. 1.
Figure 6F:
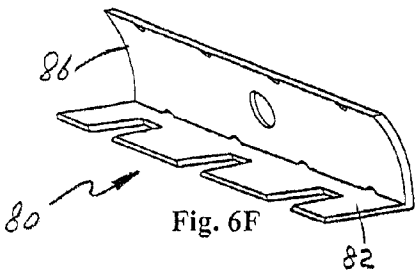
Figure 6D:
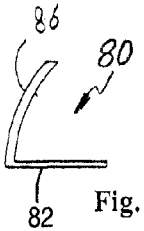
Figure 6A:
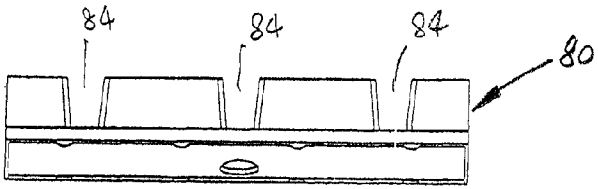
Figure 6C:
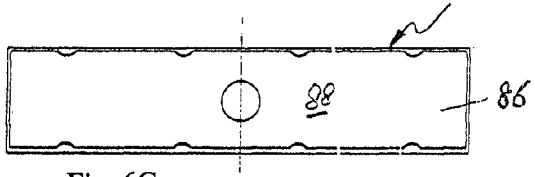
Figure 6G:
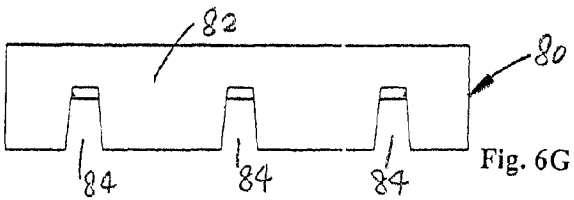
Figure 6H:
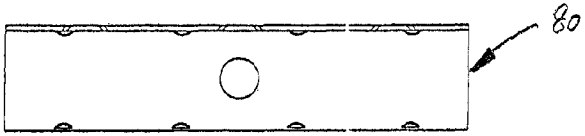
Figure 6B:
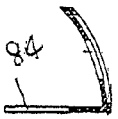
Figure 7:
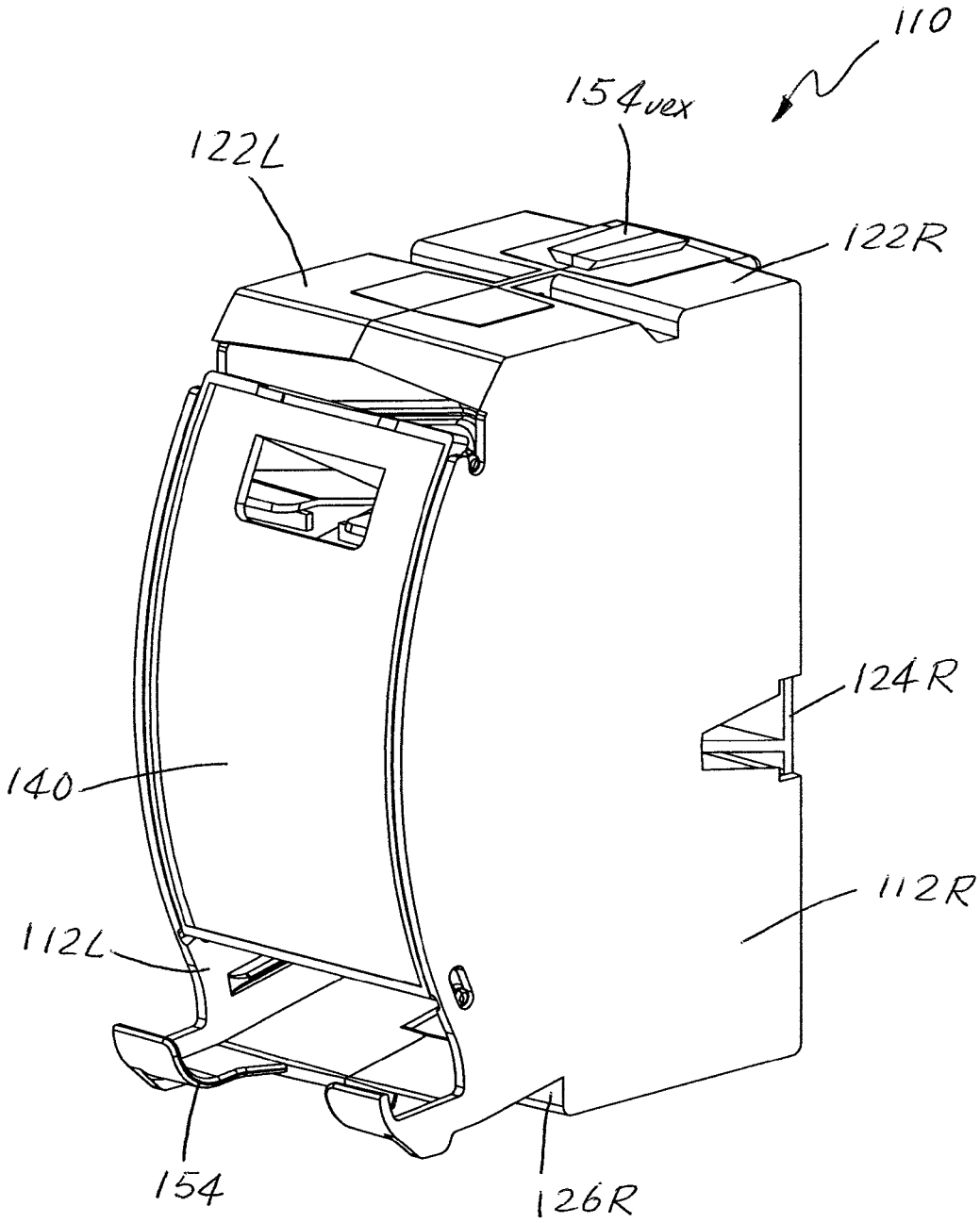
FIG. 7 shows a perspective view of a single module formed according to a second embodiment.
Figures 10A, 10B, 10C, 10D, 10E, 10F, 10G, 10H:
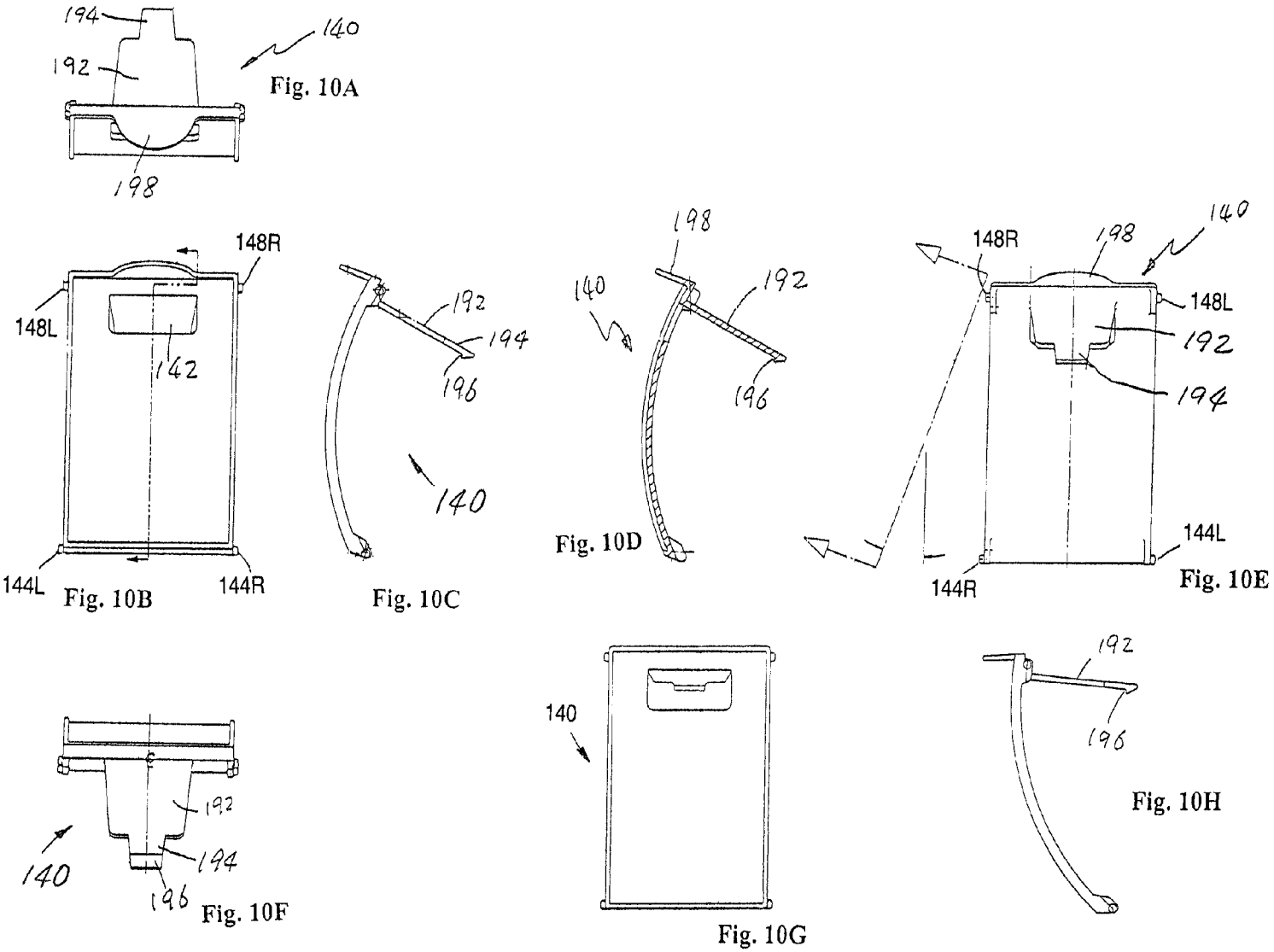
FIGS. 10A-10H show various views of the cover of the module shown in FIG. 7.
Figures 11A, 11B, 11C, 11D, 11E, 11F, 11G, 11H, 11I, 11J:
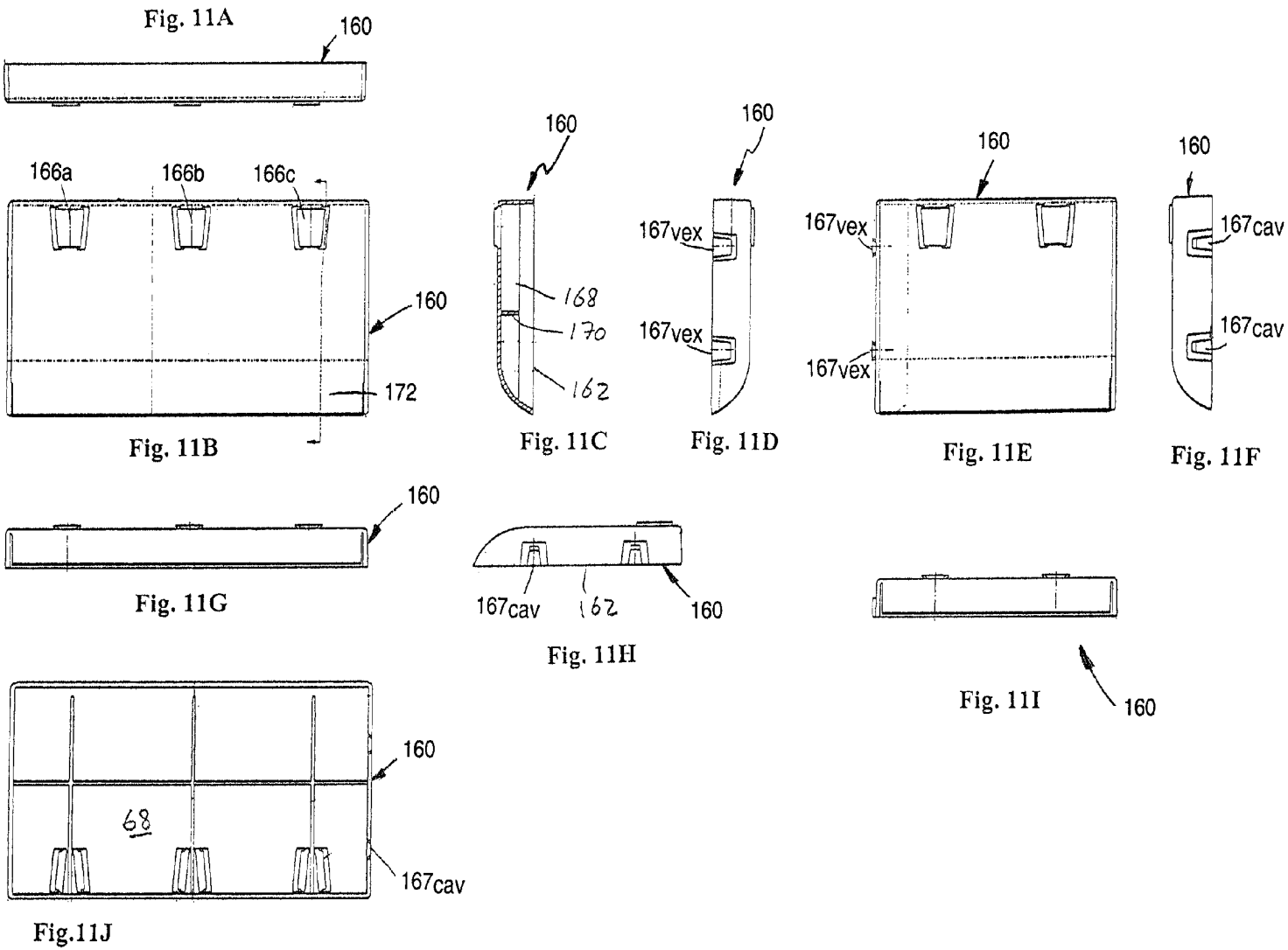
FIGS. 11A-11J show various views of the base of the module shown in FIG. 7.
Figures 12A, 12B, 12C, 12D, 12E, 12F, 12G, 12H, 12I, 12J:
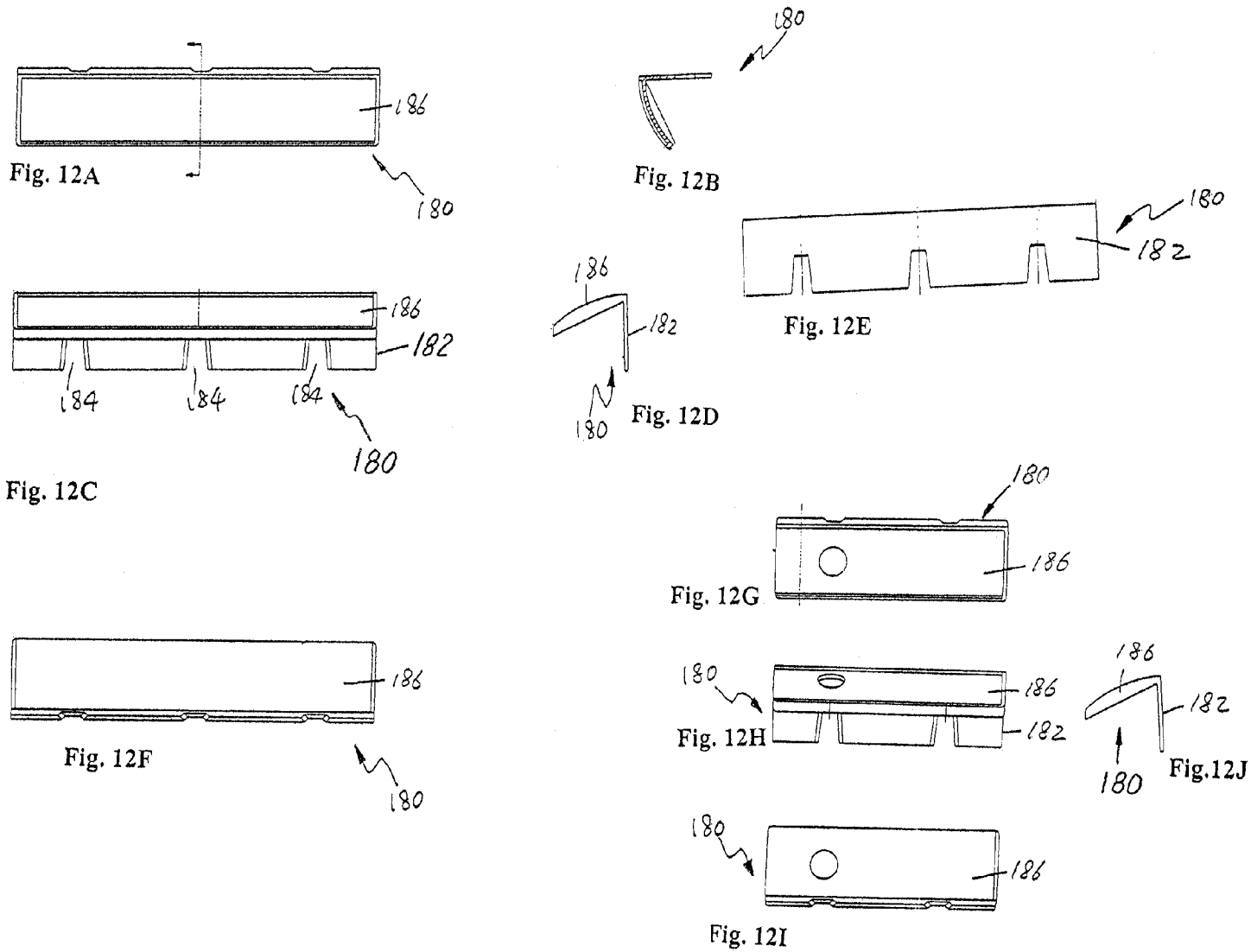
FIGS. 12A-12J shows various views of the header of the module shown in FIG. 7.

The modules 10 each comprise a left side panel 12L and a right side panel 12R, which are formed so that each of them is substantially a mirror image of the other. FIGS. 2 and 3 show various views of the respective left and right side panels 12L, 12R. As the left and right side panels 12L, 12R are formed to be substantially mirror images, one the left side panel 12L will be described in great details.

The left side panel 12L include first and second guide rails 14L, 16L extending from an inside surface of the left panel 12L and substantially perpendicularly thereto. The first and second guide rails 14L, 16L form a serpentine passage 18L therebetween. Each lap of the serpentine passage 18L is inclined downward, allowing articles to be dispensed in the assembled module 10 by gravity when the assembled module 10 is in a working position as shown in both perspective and right-side plane views of FIGS. 2A-2H.

In the example shown in FIGS. 2A-2H, the serpentine passage 18 opens at the front top portion of the left side panel 12L, declines towards the rear portion of the left panel 12L, turns and declines toward the front portion, turns and declines toward the rear portion a second time, and then turns towards the front bottom portion of the left panel 12L. In such a case, the two ends $\mathbf{20}_{in}$, $\mathbf{20}_{out}$ of the serpentine passage 18L both open at the front side of the left panel 12L. In the alternative, the serpentine passage 18L can open at both the front and rear portions of the panel 12L. In one example not shown, one end of the serpentine passage 18L can open at the rear top portion of the panel 12L. In such an example, articles are to be loaded into the module 10 from the rear thereof.

The first and second guide rails 14L, 16L can incline at different inclination angles. For example, each leg of the first and second guide rails 14L, 16L is inclined at an angle from about 10° to about 15° in relation to a horizontal direction. In one example, the inclination angle is about 11°. The inclination angle can be determined by a number factors including the weight of the articles to be dispensed, the material of the articles, the material of the guide rails 14L, 16L, and other factors.

Additionally or alternatively, the serpentine passage 18L can be formed to have various numbers of turns. In the example of FIGS. 2A-2H, the serpentine passage 18L is shown to have three turns. The first and second guide rails 14L, 16L of the left panel 12L can also be formed to provide a different number of turns.

The left panel 12L can be formed with one or more of top, rear, and bottom panels 22L, 24L, 26L. In the example shown in FIGS. 2A-2H, the top, rear, and bottom panels 22L, 24L, 26L and the left side panel 12L define a substantially rectangular shape of a module 10, after the left side panel 12L is assembled with a corresponding right side panel 12R (see, FIGS. 3A-3H). In an example not shown, the top, rear, and bottom panels 22L, 24L, 26L can assume various shapes for enhanced display effects.

The left and right side panels 12L, 12R each can be formed with various additional structures for various purposes. For example, the side panels 12L, 12R can be formed with fasteners 28L, 28R so that the side panels 12L, 12R can be joined with each other to form a module 10 (see, FIG. 1). For example, complementary fasteners, such as press-fit fasteners, can be formed on the left and right side panels 12L, 12R as are shown in their perspective views in FIGS. 2 and 3. When the complementary fastener are made to engage with one another, they connect the left and right side panels 12L, 12R to each other to result in a module 10. In an example, the fasteners 28L, 28R can be releasably connected to one another, allowing the left and right side panels 12L, 12R to be assembled and disassembled repeatedly.

In another example, the bottom panels 26L, 26R of the side panels 12L, 12R can be formed with forward extending lips 30L, 30R, respectively, to form an access tray 32 for receiving a dispensed product. The forward extending lips 30L, 30R each continue to extend upward and form a barrier 34L, 34R to retain the dispensed product in position and prevent the same from accidentally falling off the receiving tray 32. The dispensed product can thus be readily accessed by a user.

Additionally or alternatively, various connecting structures can be formed on the side panels 12L, 12R and adapted to join the module 10 to a front cover (see FIGS. 4A-4H), to another adjacent module 10, to a module base (see FIGS. 5A-5H), and/or to a module header (see FIGS. 6A-6H) as will be described below in connection with these additional components of the display and dispensing system 1.

The module 10 shown in FIGS. 2A-2H can be assembled by bringing and fastening the left and right side panels 12L, 12R to each other. For example, the side panels 12L, 12R are joined with each other by the fasteners 28L, 28R formed on such side panels 12L, 12R. In the resulting module 10, the respective guiding rails of the left and right side panels 12L, 12R are aligned to form a serpentine chute 18 inside the module 10. For example, the first guide rails 14L, 14R are aligned to each other and form a continuous front guide 14. The second guide rails 16L, 16R are aligned with each other to form a continuous rear guide 16. A serpentine chute 36 is formed between the front and rear guides 14, 16 and extends similarly to the serpentine passage 18L described above.

In one example, the first guide rails 14L, 14R are spaced from each other as the height of such guide rails 14L, 14R is less than that of the top, rear, bottom panels 22L, 22R, 24L, 24R, 26L, 26R as illustrated in the perspective views of the side panels 12L, 12R in FIGS. 2 and 3. The space between the first guide rails 14L, 14R is designed to be less than the lesser dimension of the article to be dispensed to avoid such article to fall through the space.

When the module 10 is set up for operation in a working position as shown in FIG. 1, the serpentine chute 36 (see FIGS. 2A-2H) can assist to feed rolls by gravity to the access tray 32. The dispensed articles can then be removed by a user. When the dispensed article is removed, another article can be dispensed by gravity and enter the access tray 32.

FIGS. 4A-4H show a front cover 40 provided for covering the front of the module 10 and the front and rear guides 14, 16 inside the module 10. The front cover 40 can assume a shape corresponding the shape of the front portions of the left and right side panels 12L, 12R. In the example shown in FIGS. 4A-4H, the front cover 40 have a curved profile formed in accordance with the curvature of the front portions of the side panels 12L, 12R. One skilled in the art will appreciate that the front cover can assume various other shapes, such as a straight or wavy surface (not shown).

The front cover 40 of each module 10 can be formed to provide indicia of the content in the module 10. For example, the front cover 40 can be provided with a transparent window or opening 42 to allow viewing of the products contained in the module 10. Additionally or alternatively, the front cover 40 can provide a surface for indicia of products. In one example, the front cover 40 can be made of a transparent material allowing product indicia, such as a product label, to be placed on the inside of the front cover 40 and face outside toward the user. In the alternative, the front cover 40 can be formed so that product information can be affixed on the outside surface of front cover 40. One skilled in the art will appreciate that the product information can be affixed to the front cover 40 by various other methods.

The front cover 40 can be attached to the remaining portion of the module 10 by any of various ways. In a preferred embodiment, the front cover 40 is hinged to the bottom portions of the left and right panels 12L, 12R in the module 10 to permit the front cover 40 to pivot open, such as when reloading products in the top of the chute 36. In the example shown in FIGS. 4A-4H, the front cover 40 is formed with a pair of pivoting pins 44L, 44R extending from the bottom edges of the front cover 40. The pivoting pins 44L, 44R are adapted to engage and pivot inside corresponding retaining apertures 46L, 46R in the left and right side panels 12L, 12R, respectively (see FIGS. 2 and 3).

The front cover 40 can also be formed with a pair of locking pins 48L, 48R extending from the top edges of the front cover 40. The locking pins 48L, 48R are adapted to be received in corresponding latching openings 50L, 50R in the left and right side panels 12L, 12R. As is shown in FIGS. 2 and 3, the latching openings 50L, 50R in the side panels 12L, 12R each are surrounded by a upward extending stopper 52L, 52R for maintaining the front cover 40 in a closed position and preventing the front cover 40 from opening by accident.

During operation of the front cover 40, the front cover 40 is either lifted out of or dropped in the latching openings 50L, 50R in the left and right side panels 12L, 12R. To facilitate such opening and closing operation of the front cover 40, the retaining apertures 46L, 46R in the left and right side panels 12L, 12R can be have an oblong shape, as is shown in FIGS. 2 and 3. The oblong shaped retaining apertures 46L, 46R allow cylindrical pivoting pins 44L, 44R and in turn the front cover 40 to move slightly in a vertical direction.

In the embodiment shown in FIG. 1, multiple modules 10 can be assembled together to form a modular display and dispensing system 1. For example, the modules 10 can be stacked to form multiple rows or joined side-by-side to form multiple columns. For example, each module 10 can be formed with a convex joint element $\mathbf{54}_{vex}$ on the top to connect with a concave joint element $\mathbf{54}_{cav}$ on the bottom of another module 10. In one example, the modules 10 are each formed with a convex joint element $\mathbf{54}_{vex}$ on the top surface and a concave joint element $\mathbf{54}_{cav}$ on the bottom surface. Such modules 10 can be interchanged and interconnected to form a modular system 1.

Additionally or alternatively, each module 10 can be formed with a convex joint element $\mathbf{56}_{vex}$ on one side surface to connect with a concave joint element $\mathbf{56}_{cav}$ on an opposite side of another module 10. In one example, the modules 10 each can be formed with a dovetail joint element on each of the top, bottom, and side surfaces of the module 10 to join with a complementary dovetail joint element in an adjacent module.

FIGS. 5A-5H show a base plate 60 formed to provide additional retention to modules 10 supported thereon. The base plate 60 has a bottom side 62 to be situated on a supporting structure, such as a shelf, countertop or tabletop at the point of purchase. On the top surface 64 of the base plate 60, a number of joint elements 66*a*, 66*b*, 66*c* are formed, which are complementary to the joint members on the bottom of the modules 10. In one example, the joint elements 66*a*, 66*b*, 66*c* on the base plate 60 are dovetail joint elements. As one of the perspective views in FIGS. 5A-5H shows, the base plate 60 can be formed with a hollow interior 68 on the bottom side 62. In one example, a rib 70 is formed inside the hollow interior 68 to provide stability for the base plate 60.

The base plate 60 can have an extension 72 extending beyond the assembled modules 10 in the front side. Such an extension 72 can prevent the stacked modules 10 from tipping forward and thus afford additional stability to the display and dispensing system 1. In one example, the extension 72 is provided with indicia 74 (see FIG. 1) for the products contained in the modules 10 and/or the entire display and dispensing system 1.

FIGS. 6A-6H shows a header 80, which can be used together with the modules 10 in a display and dispensing system 1. In the example shown in FIGS. 6A-6H, the header 80 has an elongated shape with an L-shaped cross-section. The header 80 has a joining plate 82 formed to be connected to the joint elements on the top of modules 10. In one example, the joining plate 82 is formed with a plurality of cut-outs 84 each to be connected to a complementary dovetail joint element formed on top of the module 10.

The front plate 86 of the header 80 extends upward from the joining plate 82. Similar to the front covers 40, the front plate 86 can provide a surface 88 for indicia of products in the modules 10 and/or the entire display and dispensing system 1. In another example not shown, the front plate can be formed in various configurations to promote the products contained in the modules. For example, the front plate can be formed to have the same shape of the products, such as one or more two-dimensional or three-dimensional soda cans for a soda display and dispensing system.

The various components of the module 10 can be formed of any of various materials. For example, one or more of the side panels 12L, 12R including top, rear, and bottom panels 22L, 22R, 24L, 24R, 26L, 26R, the front cover 40, the base plate 60, and the header 80 can be made of a plastic material through a molding process.

FIGS. 7 to 10 show a second embodiment of a module 110 similar the module 10 described above. Similar components and elements of the modules 10, 110 are formed of similar reference numerals with the same last two digits. Only differences between the two modules 110, 10 are elaborated below.

As FIGS. 8A-8G and 9A-9G show, the left and right side panels 112L, 112R are each formed with a third guide rail 117L, 117R continuously following along the serpentine passage 118L. The third guide rails 117L, 117R have a smaller height dimension compared to that of the first and second guide rails 114L, 116L, as is shown in the front side views of FIGS. 8A-8G and 9A-9G. The third guide rail 117L, 117R provide additional guidance to the products being dispensed along the serpentine passage 118L. Additionally or alternatively, the third guide rail 117L, 117R space the products away from the inside surfaces of the left and right side panels 112L, 112R and thus minimize the possibility of the products being jammed inside the serpentine chute 118.

In another example shown in FIGS. 8A-8G and 9A-9G, the first guide rails 114L, 114R are each provided with a supporting pin 190L, 190R located near the inlet of the serpentine chute 118 and facing toward each other. The supporting pins 190L, 190R operate to support a loading guide when loading articles into the module 110, as will be described below.

FIGS. 10A-10H show the front cover 140 of the second embodiment, in which a loading guide 192 is provided extending from the inside of the front cover 140. When the front cover 140 is in an opened position, the loading guide 192 exits from inside of the module 10 and extends in a substantially the same inclined direction as the upper leg of the front guide 114. The loading guide 192 is thus accessible by a user to load items onto the loading guide 192. When the front cover 140 is moved toward the closed position, as is shown in the side view in FIGS. 10A-10H, the loading guide 192 retreats into the module 10. During the retreat, the loading guide 192 inclines further downward to unload the items onto the serpentine front guide 114 by gravity.

In one embodiment, the loading guide 192 is formed with a tip portion 194, which is narrower than the remaining portion of the loading guide 192. During a loading operation, the narrowed tip portion 194 can fit between the first guide rails 114L, 114R formed in the left and right side panels 112L, 112R, respectively, and form a substantially continuous loading surface extending from the loading guide 192 to the front guide 114 (see FIG. 14). In a preferred embodiment, the tip portion 194 has a hook-like structure 196 formed on the lower surface of the tip portion 194. The hook-like structure 196 is adapted to engage with a pair of supporting pins 190L, 190R formed on the first guide rails 114L, 114R so as to support the front cover 140 in an open position during a loading operation.

The front cover 140 can also be provided with a pulling tab 198 to assist a user in opening the front cover 140. In the example shown in FIGS. 10A-10H, the pulling tab 198 can be formed to extend from the top of the front cover 140 and opposite from the loading guide 192.

FIGS. 11A-11J show the base plate 160 of the second embodiment. The base plate 160 can be formed to support two, three, or more modules 10, 110. In the example of the two-module base plate 160 (see right side of the drawing), the base plate 160 can have one or more joint elements $\mathbf{167}_{vex}$ formed on one of the side surface to connect with complementary joint elements $\mathbf{167}_{cav}$ formed on an opposite side surface of another base plate 160. For example, convex and concave joint elements $\mathbf{167}_{vex}$, $\mathbf{167}_{cav}$ are formed respectively at the left and right side surfaces of the base plate 160. Such a base plate 160 can be joined to another base plate 160 to form an expanded modular display and dispensing system 101 (see FIG. 13). In one example, the joint elements $\mathbf{167}_{vex}$, $\mathbf{167}_{cav}$ on the side surfaces of the base plate are dovetail joint elements. In another example, the concave joint elements $\mathbf{167}_{cav}$ can be in the form of cut-outs formed in the side walls of the base plate 160.

FIGS. 12A-12J show a header 180 similar to that shown in FIGS. 6A-6H.

Figure 13:
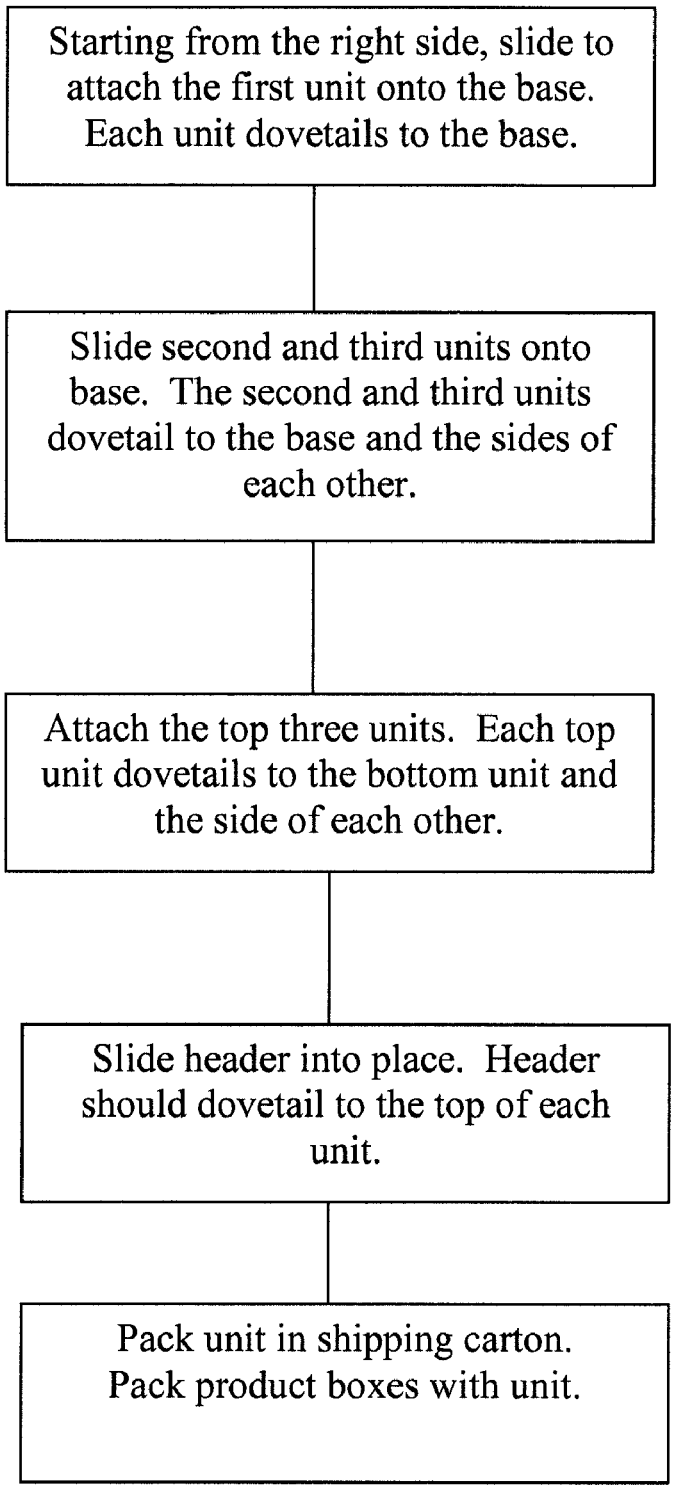
FIG. 13 shows a flowchart of the process steps of assembling a 2×3 array of modules.

FIG. 13 shows a flowchart of the process of assembling a 2×3 array of modules 110. Steps 1 and 2 in FIG. 13 indicate that the bottom row of modules 120 are attached to a base plate 160. During steps 1 and 2, each of the modules 110 in the bottom row is dovetailed to the base plate 160 and to the adjacent module(s) 110. Step 3 indicates that the top row modules are then attached to the bottom row modules by the dovetail joint elements on the respective modules 110. In Step 4, the header 180 is assembled, resulting in a final modular display and dispensing system 101.

The above assembling steps can be carried out at the point of purchase, such as a store. In such a case, the assembled modular display and dispensing system 101 is ready for loading the products as described below in connection with FIG. 14. Alternative, the assembling steps 1-4 can be carried out by the manufacturer. In such a case, the assembled modular display and dispensing system 101 can be packed in a shipping carton, as indicated in step 5, to be delivered to customers. Optionally, the products to be dispensed can be packed and shipped to the customers at the same time.

Figure 14:
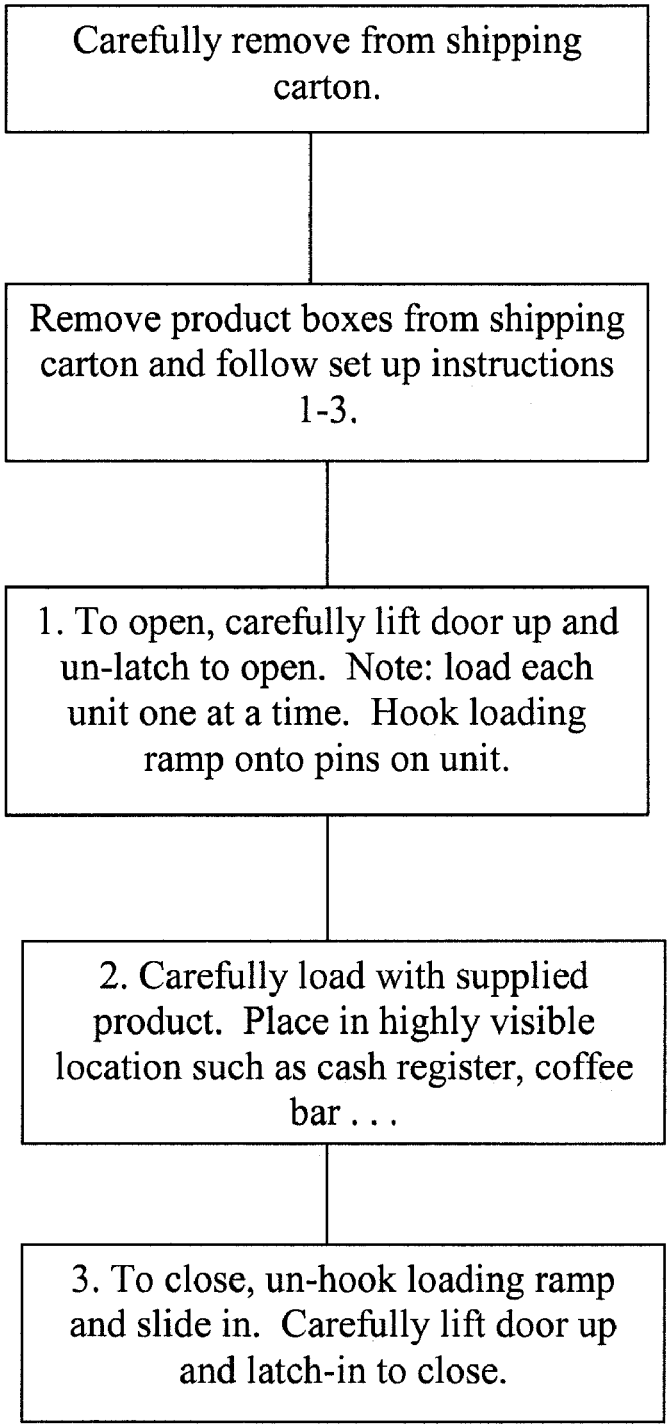
FIG. 14 shows a flowchart of the process steps of loading the assembled modular array.

FIG. 14 shows a flowchart of the process of loading the modular array of FIG. 13. To open the front cover 140, lift the front cover 140 to unlatch the locking pins 148L, 148R on the front cover 140 as indicated in step 1 of the opening operation. Then, engage the hook-like structure 196 on the loading guide 192 with the supporting pins 190L, 190R on the left and right first guide rails 114L, 114R, as indicated in step 2 of the opening operation. The loading guide 192 thus extends the front guide 114 outside the module 110 for easier access by a user. For example, products can be placed onto the loading guide 192, which leads the products onto the front guide 114.

After the loading operation is completed, the loading guide 192 is unhooked from the supporting pins 190L, 190R. The front cover 140 can then be closed. When the locking pin 148L, 148R on the front cover 140 reaches the latching opening 150L, 150R on the side panels 112L, 112R, the front cover 140 is lifted to allow the locking pins 148L, 148R to be retained in position in the latching opening 150L, 150R.

The loaded display and dispensing system 101 is ready for use. In one example, the display and dispensing system 101 can be placed in a highly visible location in the store, such as by a cash register.

While there have shown and described and pointed out fundamental novel features of the invention as applied to a preferred embodiment thereof, it will be understood that various omissions and substitutions and changes in the form and details of the devices illustrated, and in their operation, can be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention can be incorporated in any other disclosed or described or suggested form or embodiment as a general matter of design choice. It is the intention, therefore, to be limited only as indicated by the scope of the claims appended hereto.

The invention claimed is:

1. A modular display and dispensing system for a product, the system comprising:

at least one module, each module comprising:

a left side panel and a right side panel, each of the side panels including an inside surface, a top panel, a rear panel, a bottom panel, a front rail extending perpendicularly from the inside surface, and a back rail extending perpendicularly from the inside surface and spaced apart from the front rail, wherein the top panel, rear panel, and bottom panel of the left and right panels are respectively aligned to form a top surface, a rear surface, and a bottom surface of the module, and the front rails of the left and right panels and the back rails of the left and right panels, are respectively aligned to form a downwardly-inclined continuous serpentine passage for the product extending from near the top surface of the module to near the bottom surface of the module, the passage having a top opening for loading of the product and a bottom opening for dispensing of the product; and a front cover removably installed between the left and right panels and configured to pivot open at the top to allow loading of the product into the top opening of the passage, wherein the front cover comprises a loading guide attached to an inner surface of the front cover, so that the loading guide extends between the front cover and the top opening of the passage when the front cover is opened.

2. The system of claim 1, wherein each module further comprises a dispensing tray extending from the bottom opening of the passage.

3. The system of claim 1, wherein there is a gap between the front rail of the left side panel and the front rail of the right side panel, the gap being smaller than a length of the product.

4. The system of claim 1, wherein the passage is downwardly-inclined from horizontal at an angle of about 10 degrees to about 15 degrees.

5. The system of claim 1, wherein the passage has at least three turns.

6. The system of claim 1, wherein the left and right panels comprise complementary fasteners configured to join the left and right panels for assembly of the module.

7. The system of claim 1, wherein the left side panel and the right side panel each further comprise a middle rail extending perpendicularly from the inside surface, in a position between the front rail and the back rail, the middle rail extending from the inside surface by a shorter distance than the front and back rails, so that a gap between the middle rail of the left side panel and the middle rail of the right side panel is larger than a length of the product.

8. The system of claim 1, wherein the front cover is at least in part transparent to allow viewing of the product.

9. The system of claim 1, wherein the front cover comprises locking pins at a top portion thereof and pivoting pins at a bottom portion thereof, the pivoting pins being configured to fit into corresponding oblong retaining apertures of the left and right side panels to allow movement of the front cover in an upward direction, and the locking pins being configured to fit into latching openings of the left and right side panels, so that movement of the front cover in the upward direction disengages the locking pins from the latching openings to allow the front cover to pivot open.

10. The system of claim 1, wherein the loading guide has an angle of inclination substantially the same as that of an upper portion of the passage when the front cover is opened to a loading position.

11. The system of claim 1, wherein the loading guide has an angle of inclination that increases as the front cover is closed.

12. The system of claim 1, wherein the loading guide has a narrow portion at a distal end thereof, the narrow portion having a width that is narrower than a gap between the front rail of the left side panel and the front rail of the right side panel.

13. The system of claim 12, wherein the narrow portion of the loading guide has a hook-like structure on an underside thereof, the hook-like structure being configured to engage with pins extending from the front rail of the left side panel and the front rail of the right side panel when the front panel is opened to a loading position.

14. The system of claim 1, further comprising a base plate configured to retain a plurality of modules, the base plate having joint elements on a top surface thereof that are configured to mate with corresponding joint elements on the bottom surfaces of the modules.

15. The system of claim 14, wherein the base plate comprises a plurality of separable base plate elements, the base plate elements each having joint elements on at least one side surface thereof, the joint elements being configured to mate with corresponding joint elements of adjoining base plate elements.

16. The system of claim 1, further comprising a header plate configured to retain a plurality of modules, the header plate having joint elements on a bottom surface thereof that are configured to mate with corresponding joint elements on the top surfaces of the modules.

17. The system of claim 16, wherein the header plate is an elongate element having a substantially L-shaped cross-section.

18. The system of claim 1, further comprising:

a base plate configured to retain a plurality of modules, the base plate having joint elements on a top surface thereof that are configured to mate with corresponding joint elements on the bottom surfaces of the modules, wherein a plurality of modules are arranged on the base plate so as to form a plurality of stacked rows of modules.

19. The system of claim 18, wherein, in adjacent stacked rows of modules, each module in a lower row of the adjacent rows has a joining element on the top surface thereof which is configured to join with a corresponding joining element on the bottom surface of a corresponding module in an upper row of the adjacent rows.

* * * * *